US005772010A

United States Patent [19]

Watanabe et al.

[11] Patent Number: 5,772,010

[45] Date of Patent: Jun. 30, 1998

[54] PUSH BUTTON SWITCH

[75] Inventors: Hisashi Watanabe; Shoji Takeda, both of Okayama, Japan

[73] Assignee: Matsushita Electric Industrial Co., Ltd., Osaka, Japan

[21] Appl. No.: 753,612

[22] Filed: Nov. 27, 1996

[30] Foreign Application Priority Data

Nov. 28, 1995 [JP] Japan ..... 7-308699

[51] Int. Cl.[6] ..... H01H 5/18

[52] U.S. Cl. ..... 200/406; 200/342; 200/534

[58] Field of Search ..... 200/406, 342, 200/534

[56] References Cited

U.S. PATENT DOCUMENTS

| | | | |
|---|---|---|---|
| 4,405,845 | 9/1983 | Kondo et al. . | |
| 4,843,197 | 6/1989 | Kojima et al. | 200/406 |
| 5,172,114 | 12/1992 | Bedoya et al. | 200/342 X |
| 5,199,557 | 4/1993 | Brandt et al. | 200/406 |
| 5,448,032 | 9/1995 | Wagatuma | 200/534 |

*Primary Examiner*—Renee S. Luebke
*Attorney, Agent, or Firm*—McDermott, Will & Emery

[57] ABSTRACT

A push button switch for use with an operating key of electronic appliances having a long working stroke, a clear step feeling during the switching operation, and an over-stroke after switching is complete. The switch contains a pressure member 17 made of elastic material disposed between the push button 18 and movable contact point 16. As the domed movable contact point 16 is pressed during the switching operation via the pressure member 17, the working stroke of the switch can be made longer for a quantity equivalent to that of the compression deformation in the pressure member 17, before and after the reversal action of the domed movable contact point 16. Also, there is provided a clearance for outward expansion for the top extrusion of the pressure member 17 during compression deformation. Due to the alignment of these components, the possibility of the pressure member 17 and push button 18 dislocating or rattling is minimized. Once the top part of the push button 18 has been pressed with an operating key of the electronic appliance and the switching is complete, the lid 19 of the box-shape case 11 protects the push button 18 and the movable contact point 16 from excessive forces or damage.

4 Claims, 3 Drawing Sheets

PUSH BUTTON SWITCH

FIELD OF THE INVENTION

The present invention relates to a push button switch having a long stroke and a distinct step-like feeling during operation for use with an operating key of electronic appliance.

BACKGROUND OF THE INVENTION

Due to the sophistication and diversification of various electronic appliances, such electronic appliances comprise components having sophisticated properties. For example, regarding the technology of push button switch components, there exists a need to improve their operational properties to provide anti-operating error functions and alleviate operator fatigue during repetitious type work. In particular, a long working stroke, a step-like motion and an on-switch overstroke would be desirable.

A conventional push button switch is illustrated in FIG. 4 and is described below as follows. FIG. 4 shows a push button 7 disposed in a resin molded box-shape case 1 where at the bottom of the case are outer fixed contact points 3A, 3B coupled with a terminal 2, having a center fixed contact point 5 coupled with another terminal 4, which is provided and affixed by an insert-molding method. Above the outer fixed contact points 3A, 3B exist a reversal action type domed movable contact point 6 made of elastic metal plate and provided as a switching contact. The push button 7 located above is made of rigid material and is movable in the upward and downward direction. The bottom part 8 of the push button touches the upper part of the movable contact point 6 while the top extrusion 9 appears above from a center hole 11 of a lid 10 which covers the opening of the case 1.

The push button functions by pressing the top extrusion 9 of the push button 7 through the operating key, or the like, of an electronic appliance. The push button 7 goes downward to press the top center of the movable contact point 6 at the bottom part 8, thereby electrically connecting the outer fixed contact points 3A, 3B and the center fixed contact point 5 with the terminal 2. Once this compression force on push button 7 is withdrawn, the movable contact point 6 returns to the original state by its elastic restoration force, whereby the electrical contact between terminal 2 and terminal 4 is broken.

The conventional push button switch described above provides a working stroke which is limited by the reversal action of movable contact point 6, which stroke is determined by the shape and dimensions of the domed movable contact point 6 made with an elastic metal plate. As a result, it is difficult to satisfy the market requirements for a longer working stroke, a step-like motion and an on-switch overstroke.

Other conventional designs have attempted to solve the above described problems by providing a rubber-made domed contact point having an electrical contact on it. However, these particular designs also fail to provide a clear step-like feel during their switching operation.

SUMMARY OF THE INVENTION

According to the present invention a push button switch is provided for electronic appliances having a long stroke and a distinct step feel during its switching operation, as well as a sufficient overstroke after switching-on the push button.

According to the present invention, the push button switch comprises a pressure member made of an elastic material placed between the push button and a movable contact point which makes a reversal action. During the switching operation of the push button, the pressure member is deformed by a certain quantity before and after the reversal action of the movable contact point.

As a result, the working stroke of the push button during its switching operation is made greater. Furthermore, an overstroke having a step-like feeling is provided after switching-on the push button.

As pointed out in greater detail below, the push button switching operation provides important advantages. The working stroke of the push-on operation is greater than that of the prior art switches. The overstroke after switching-on the push button is accompanied by a clear step feeling, also not found in the prior art.

Furthermore, it should be understood that the feel associated with operating the push button switch, such as the magnitude of the working stroke, operating force, etc., may be adjusted by modifying the shape or material of the pressure member.

BRIEF DESCRIPTION OF THE DRAWINGS

FIG. 2(*b*) shows a cross sectional view of the push button switch of FIG. 1 in a state when the movable contact point is reversed.

FIG. 2(*c*) shows a cross sectional view of the push button switch of FIG. 1 in a state when the switching action is completed.

FIG. 2(*d*) shows a cross sectional view of the push button switch of FIG. 1 in a state in which an increased force is exhorted on the push button.

DESCRIPTION OF PREFERRED EMBODIMENTS

Figure 1:
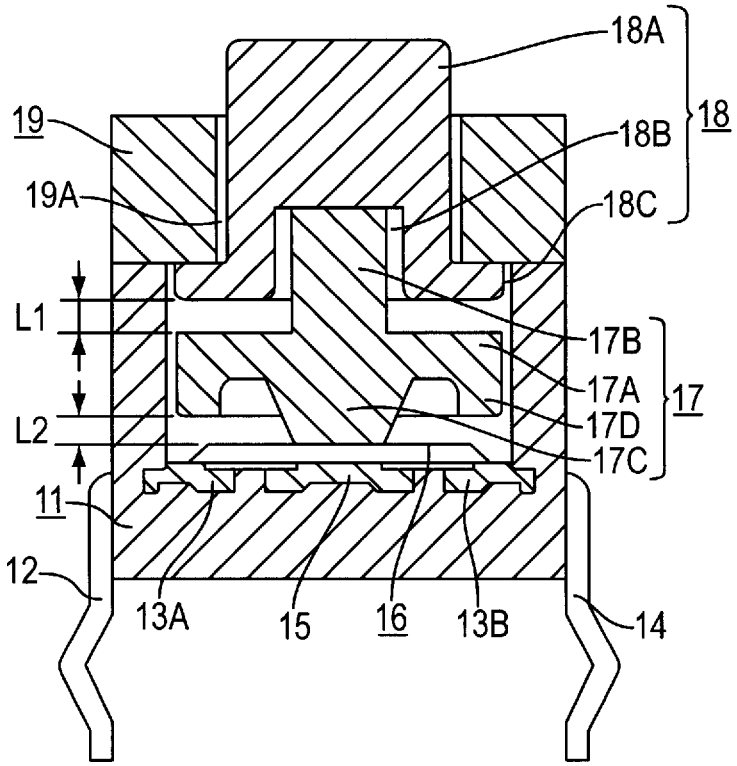
FIG. 1 shows a cross sectional view of a push button switch according to an embodiment of the present invention.
Figure 2A:
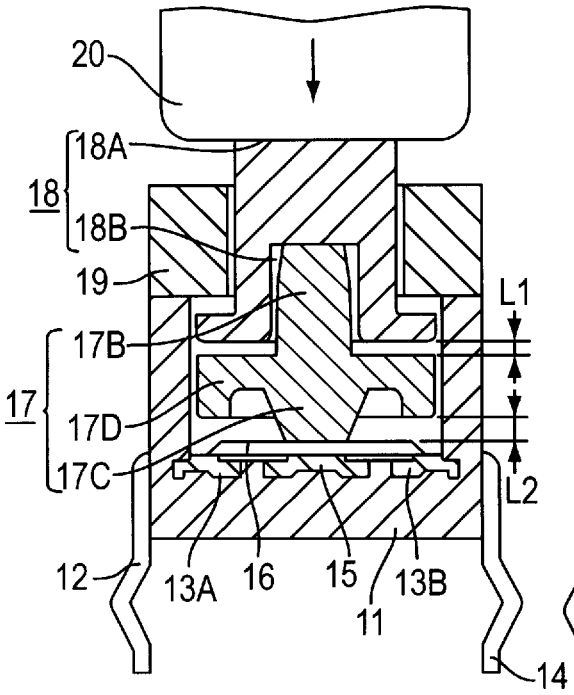
FIG. 2(*a*) shows a cross sectional view of the push button switch of FIG. 1 in a state when push button is pressed.
Figure 2B:
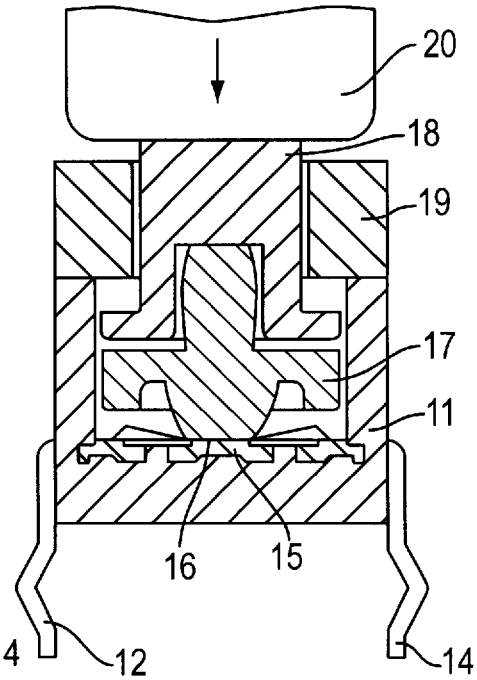
Figure 2C:
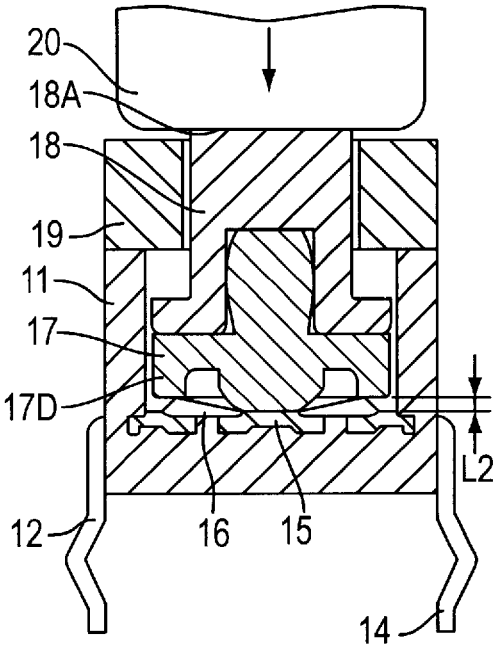
Figure 2D:
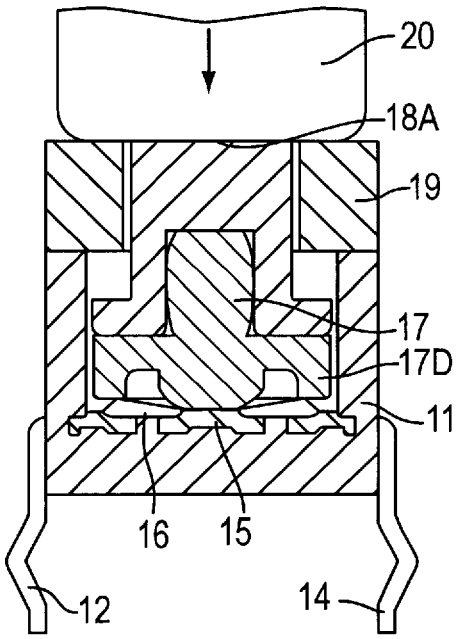

The present invention includes: a resin molded box-shape case having terminals for connecting a printed circuit board, etc.; a center fixed contact point, and an outer fixed contact point at the bottom; a reversal action type domed movable contact point made of elastic metal plate provided on the outer fixed contact point in the box-shape case; and a pressure member made of elastic resin or rubber material, movably supported in an upward and downward direction along the inner wall surface of the box-shape case. The pressure member is disposed on the top surface of the movable contact point and a push button is disposed on top of the pressure member, movably supported—upwards and downwards—through a center hole of a lid covering the top opening of the box-shape case. The pressure member has a cylindrical body with an extrusion located on both its top and bottom center. As the push button is pushed downward against the pressure member, the movable contact point is reversed by a force conveyed by the pressure member and the terminals are electrically contacted. As a result, the working stroke of the push button switch is made longer by a quantity proportionate to the deformation of the pressure member—due to its elasticity—caused during the push button switching operation, as briefly described above.

In addition, the present invention includes the pressure member having: a cylindrical body with an extrusion located on both its top and bottom center; a flange skirt on its perimeter; a specified clearance provided between its top flat surface and the bottom end of the push button; and a specified clearance between the bottom end of its flange skirt and the top surface of the movable contact point, disposed on the bottom of the box-shaped case.

The compressive forces required to initialize the deformation of a single extrusion of the pressure member is less than the reversal force of the movable contact point. On the other hand the compressive forces required to initialize the deformation with the both of the extrusions of the pressure member is greater than the reversal force of the movable contact point. Moreover, the compressive force of initiating the deformation of the flange skirt is larger than any of the forces required for initiating the deformation of either extrusion.

As a result of the relationship between the extrusions, movable contact point and flange skirt, as described above, the deformation of either extrusion provided at the top center or bottom center of the pressure member can be achieved prior to the movable contact point making its reversal action. Thereafter, the compressive forces will deform the remaining extrusion after the reversal action of movable contact point has begun.

Finally, the present invention provides a working stroke prior to the switch-on and a working stroke after the switch-on, which are longer compared with conventional push buttons, whereby the switch-on is attributed solely to the reversal action of movable contact point. Consequently, the entire working stroke of the present invention becomes longer than conventional designs.

In addition, the present invention includes a push button switch, whereby the extrusion provided at the top center of pressure member is coupled with the push button at a hollow provided in the bottom center of the push button. The hollow provides a clearance around the outer circumference of the extrusion. The top end of extrusion touches the ceiling of the hollow. The push button is provided with a flange around its bottom circumference. The top surface of the flange touches the bottom of the lid to prevent the push button from falling out.

According to the present invention described above, clearance is provided around the top extrusion, thereby allowing for an outward expansion of the extrusion during its deformation, which is caused by the compressive forces imposed upon it during the push button switching operation. Moreover, the alignment of the components of the present invention described above, prevents the push button from rattling or dislocating from the box shaped case.

In addition to the embodiment described above, the present invention includes another embodiment of the push button switch whereby: each of the extrusions of the pressure member is deformed by the compressive forces exerted by pressing the push button; the movable contact point is reversed; and the top surface of push button sinks to the same level as the top surface of the lid after the flange skirt of the pressure member is pressed against the outer perimeter of the movable contact point. The switching operation described above is commenced by pressing the top of the push button with an operating key of an electronic appliance. The movable contact point is protected from excessive forces imposed upon it by the forces caused by the movement of operating key, push button, and pressure member as a result of the lid of the box-shape case preventing the operating key from extending beyond the threshold of the lid.

Turning now to the drawings, FIG. 1 is a cross sectional view showing the push button switch having outer fixed contact points 13A, 13B connected with terminals 12, 14, and a center fixed contact point 15 fixed at the bottom of a resin molded box-shaped case 11, which may be fabricated by an insert molding method. A reversal action type domed movable contact point 16 made of elastic metal plate is provided on the outer fixed contact points 13A, 13B to form a switching contact.

On the top of the domed movable contact point 16 is disposed a pressure member 17 made with elastic resin, rubber, or other elastic materials. A push button 18 is disposed on the pressure member 17 made with a rigid material. The top end 18A of the push button 18 is extruding through a center hole 19A of a lid 19 covering the opening of the box-shape case 11.

The pressure member 17 is comprised of extrusions 17B, 17C disposed upward and downward, respectively, in the center of the flat part 17A. The reverse trapezium downward shaped extrusion 17C is placed on the top center of the domed movable contact point 16. The cylindrical upward extrusion 17B is fitted to a bottom hollow 18B of the push button 18 having a clearance between the outer surface of the extrusion 17B and the hollow 18B. The top end of upward extrusion 17B touches the ceiling of the hollow 18B providing a specified clearance L1 between the flat part 17A of the pressure member 17 and the bottom surface of push button 18.

Furthermore, a flange skirt 17D having a thick pipe shape is provided at the lower circumferential part of the flat part 17A of the pressure member 17, thereby providing a specified clearance L2 between the bottom surface of flange skirt 17D and the outer circumference of the domed movable contact point 16.

The embodiment as described above, provides a relationship among its components whereby the magnitude of the force F1 of the initial compression deformation imparted on the upward extrusion 17B (diameter D1) is less than the force F2 exerted on the downward extrusion 17C (diameter D2). Further, the flange skirt 17D (diameter D3), having a large wall-thickness, exerts a downward force F3. Finally, the force F4 of the reversal action of the movable contact point 16 (diameter D4) has a relative magnitude as set forth in the following equation: $F1<F4<F2<F3$.

The push button 18 is provided with a flange part 18C at the bottom circumference for preventing the push button from coming out in the upward direction. The upper surface of flange part 18C touches the bottom surface of lid 19 when the push button is not being pressed, thereby preventing the push button 18 from rattling.

The operation of a push button switch according to the present invention is described in greater detail as follows. While the push button is in the normal state as shown in FIG. 1, an operating key 20 of an electronic appliance presses the top surface 18A of push button 18. The push button 18 moves downward pressing the top extrusion 17B of pressure member 17 which is touching the ceiling of hollow 18B. In turn, the pressure member 17 is lowered so that its bottom extrusion 17C comes in contact with the movable contact point 16, as shown in FIG. 2(*a*).

In accordance with above listed formula representing the relationship of the compressive forces for initiating the various deformations, the force F1 exerted on the top extrusion 17B causes the pressure member 17 to decrease in height due to the deformation. As a result, the clearance L1 is reduced and as the force pressing the pressure member 17 increases the movable contact point 16 also starts to gradually deform. Once the force exerted on the pressure member 17 reaches a particular compressive force F4, the movable contact point 16 reverses providing a step feeling for the operator of the push button, as shown in FIG. 2(*b*). At which time, the outer fixed contact points 13A, 13B and the center fixed contact point 15, and terminals 12, 14 are electrically connected while the clearance L2 is reduced.

Next, the top extrusion 17B of the pressure member 17 is coupled with the push button 18 at the bottom hollow 18B whereby a clearance around the extrusion is provided. Therefore, the top extrusion 17B has clearance to swell outward when deformed due to pressure exerted from above, i.e., from the push button 18. Due to the overlap of the flange part 18C with the lid 19 and the pressure member 17, and the alignment of the top extrusion 17B in the bottom hollow 18B of the push button 18, the possibility of any dislocations or tilting between push button 18 and pressure member 17 is minimal.

As best shown in FIG. 2(*c*), once the compressive force exerted on the pressure member 17 is further increased to the requisite force F2, the bottom extrusion 17C also experiences deformation whereby the clearance L2 is further reduced. Eventually, the clearance L1 between the top surface of flange skirt 17D and the bottom surface of push button 18 becomes zero, and the flange skirt 17D is pressed in between the bottom surface of push button 18 and the outer circumference of the movable contact point 16 to complete the switching-on operation.

As best shown in FIG. 2(*d*), as the pressure member 17 exhorts an even greater force F3, the flange skirt 17D undergoes compression deformation until the top surface 18A of the push button 18 reaches the same level as the top surface of the lid 19. At which time, the operating key 20 of electronic appliance, pressing the top surface 18A of push button 18, is blocked by the top surface of lid 19 and the lowering of pressure member 17 is completed.

Once the pressure exerted by the operating key 20 on the push button 18 is withdrawn, the switch is restored to its original state as illustrated in FIG. 1. The elasticity of the movable contact point 16 and pressure member 17 restores the components to their original positions and the electrical contact between the terminals 12, 14 is broken.

The embodiment described above provides a number of significant advantages. The additional strokes are due to the compression deformation of the top extrusion 17B and the bottom extrusion 17C of the pressure member 17, both before and after the reversal action of movable contact point 16. Also, the working stroke of the push button switch is considerably greater than the conventional design, whereby the stroke is affected solely by the reversal action of movable contact point 16. Moreover, the push button switch is protected from possible overstroke occurring after the reversal action.

In the above described embodiment, the extrusions 17B, 17C provided at the top center and bottom center, respectively, of the pressure member 17, the larger outer diameter (D2) of bottom extrusion 17C is set to be greater than the diameter (D1) of top extrusion 17B, and the force F2 of the initiating compression with the bottom extrusion 17C is greater than the force F4 for the reversal action of the movable contact point 16. Also, the force F1 of the initial compression of the top extrusion 17B is less than force F4 for the reversal action of movable contact point 16.

Figure 3:
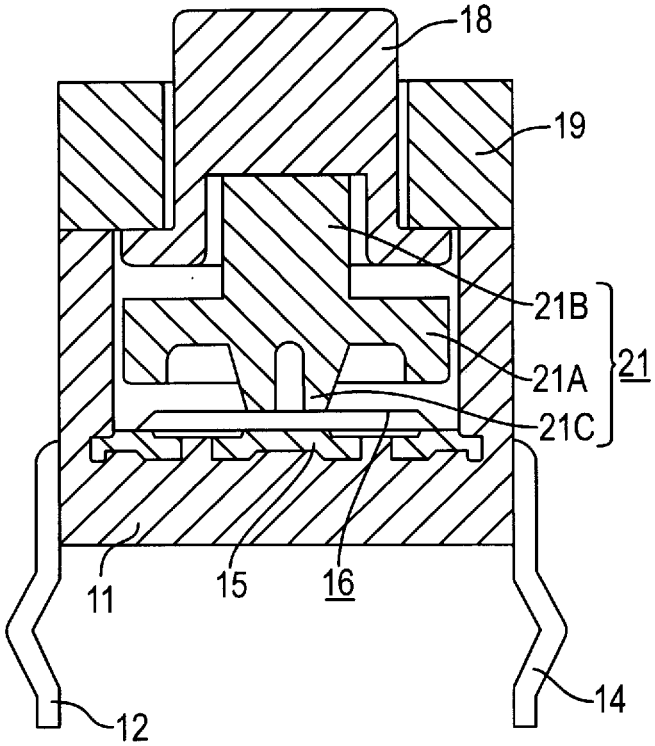
FIG. 3 shows a cross sectional view of a push button switch according to an alternate embodiment of the present invention.
Figure 4:
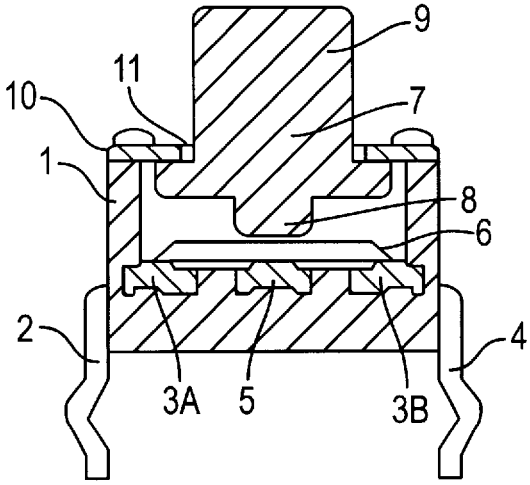
FIG. 4 PRIOR ART
FIG. 4 shows a cross sectional view of a prior art push button switch.

However, variations on the embodiment described above are possible. For example, as best shown in FIG. 3, provided is a push button switch having the diameter of the top extrusion 21B on the flat part 21A of the pressure member 21 greater than the largest outer diameter of bottom extrusion 21C. In turn, this sets the initial compression force to be greater than the force for the reversal action of movable contact point 16. Also provided is a bottom extrusion 21C having a cavity. In turn, this sets the force of the initial compression to be smaller than the force for reversal action of movable contact point 16, while obtaining the same effects as the embodiment described previously.

Of course, it should be understood, that a wide range of changes and modifications can be made to the preferred embodiments described above. It is therefore intended that the foregoing detailed description be regarded as illustrative rather than limiting and that it is to be understood that it is the following claims, including all equivalents, which are intended to define the scope of the invention.

We claim:

1. A push button switch comprising:

a resin molded box-shape case having a terminal, a center fixed contact point and an outer fixed contact point fixed at said box-shaped case;

a reversal action domed movable contact point made of elastic metal plate disposed on said outer fixed contact point in said box-shaped case;

a pressure member made of elastic resin or rubber material, said pressure member having a top and bottom surface, said pressure member having a cylindrical body with an upper extrusion extending upwardly from a center portion of a flat top surface of said cylindrical body, a lower extrusion extending downwardly from a center portion of a bottom of said cylindrical body and a flange skirt extending downwardly from a circumference of said bottom of said cylindrical body, said pressure member disposed within said box-shaped case and movable up and down along an inner wall surface of said box-shape case, and said pressure member touching the center of a top surface of said movable contact point; and a push button disposed on top of the pressure member, and movable up and down through a center hole of a lid covering a top opening of said box-shaped case wherein a specified clearance is provided between the top flat surface of said pressure member including said circumference and said bottom surface of said push button, wherein a specified clearance is provided between said bottom surface of said flange skirt and an outer circumference of said movable contact point disposed at the bottom of said box-shaped case, wherein a force for starting deformation of the upper extrusion of said pressure member is smaller than a reversal force of said movable contact point, wherein a force for starting deformation of the lower extrusion of said pressure member is larger than the reversal force of said movable contact point, and wherein a force for starting compression deformation of said flange skirt is greater than any of said forces of starting deformation with the upper and lower extrusions.

2. The push button switch of claim 1, wherein the upper extrusion provided at the top center of said pressure member is disposed within a hollow provided in a bottom center of said push button for securing a clearance around an outer circumference of the upper extrusion, wherein a top end of said upper extrusion touches a ceiling of said hollow, and wherein the push button has a bottom circumference that is provided with a flange around the bottom circumference that touches a bottom surface of said lid for preventing the push button from coming out of said box-shaped case.

3. A push button switch comprising:

a resin molded box-shape case having a terminal, a center fixed contact point and an outer fixed contact point fixed at said box-shaped case;

a reversal action domed movable contact point made of elastic metal plate disposed on said outer fixed contact point in said box-shaped case;

a pressure member made of elastic resin or rubber material, said pressure member having a cylindrical body with an upper extrusion extending upwardly from a center portion of a flat top surface of said cylindrical body, a lower extrusion extending downwardly from a center portion of a bottom of said cylindrical body and a flange skirt extending downwardly from a circumference of said bottom of said cylindrical body, said pressure member disposed within said box-shaped case and movable up and down along an inner wall surface of said box-shape case, and said pressure member touching the center of a top surface of said movable contact point; and a push button disposed on top of the pressure member, and movable up and down through a center hole of a lid covering a top opening of said box-shaped case, wherein the upper and lower extrusions of said pressure member are subjected to compression deformation by a force imparted by the push button, and the movable contact point makes reversal action, and whereby a top surface of the push button sinks to a level aligned with a top surface of the lid and the flange skirt of said pressure member is jammed between a bottom surface of said push button and the outer circumference of said movable contact point.

4. A push button switch comprising:

a resin molded box-shape case having a terminal, a center fixed contact point and an outer fixed contact point fixed at the bottom of said box-shaped case;

a reversal action domed movable contact point made of elastic metal plate disposed on said outer fixed contact point in said box-shaped case;

a pressure member made of elastic resin or rubber material, said pressure member having a top and bottom surface, said pressure member having a cylindrical body with an upper extrusion extending upwardly from a center portion of a flat top surface of said cylindrical body, a lower extrusion extending downwardly from a center portion of a bottom of said cylindrical body and a flange skirt extending downwardly from a circumference of said bottom of said cylindrical body, said pressure member disposed within said box-shaped case and movable up and down along an inner wall surface of said box-shape case, and said pressure member touching the center of a top surface of said movable contact point; and a push button disposed on top of the pressure member, and movable up and down through a center hole of a lid covering a top opening of said box-shaped case, wherein a specified clearance is provided between the top flat surface of said pressure member including said circumference and said bottom surface of said push button, wherein a specified clearance is provided between said bottom surface of said flange skirt and an outer circumference of said movable contact point disposed at the bottom of said box-shaped case, wherein a force for starting deformation of the upper extrusion of said pressure member is smaller than a reversal force of said movable contact point, wherein a force for starting deformation of the lower extrusion of said pressure member is larger than the reversal force of said movable contact point, wherein a force for starting compression deformation of said flange skirt is greater than any of said forces of starting deformation with the upper and lower extrusions.id movable contact point, wherein the upper and lower extrusions of said pressure member are subjected to compression deformation by a force imparted by the push button, and the movable contact point makes reversal action, and whereby a top surface of the push button sinks to a level aligned with a top surface of the lid and the flange skirt of said pressure member is jammed between a bottom surface of said push button and the outer circumference of said movable contact point.

* * * * *